US011060279B1

(12) United States Patent
Hu

(10) Patent No.: US 11,060,279 B1
(45) Date of Patent: Jul. 13, 2021

(54) FIRE-RESISTANT UTILITY POLE SLEEVE

(71) Applicant: Zhengping Hu, Shanghai (CN)

(72) Inventor: Zhengping Hu, Shanghai (CN)

( * ) Notice: Subject to any disclaimer, the term of this patent is extended or adjusted under 35 U.S.C. 154(b) by 0 days.

(21) Appl. No.: 16/854,994

(22) Filed: Apr. 22, 2020

(51) Int. Cl.
*B32B 1/08* (2006.01)
*E04B 1/94* (2006.01)
*E04H 12/02* (2006.01)

(52) U.S. Cl.
CPC ..... *E04B 1/94* (2013.01); *E04H 12/02* (2013.01)

(58) Field of Classification Search
CPC ..... B32B 1/08
See application file for complete search history.

(56) References Cited

U.S. PATENT DOCUMENTS 1,517,846 A * 12/1924 Lewis ..... E04H 12/2292 52/302.5
2,877,124 A * 3/1959 Welsch ..... C03C 3/093 501/38
2,882,173 A * 4/1959 Welsch ..... C03C 13/00 501/30
4,201,247 A * 5/1980 Shannon ..... E04B 1/88 138/140
4,644,722 A * 2/1987 Phillips ..... E04H 12/2292 52/514
5,326,410 A * 7/1994 Boyles ..... B29C 65/342 156/188
5,633,057 A * 5/1997 Fawley ..... B29C 53/562 428/36.1
5,746,031 A * 5/1998 Burns ..... A62C 2/00 248/519
8,151,898 B2 * 4/2012 Merchant ..... A62C 3/02 169/46
2017/0101801 A1 * 4/2017 Van Hoek-Patterson ..... E04B 1/72

* cited by examiner

*Primary Examiner* — Andrew T Piziali
(74) *Attorney, Agent, or Firm* — Marin Patents, LLC; Gustavo Marin; Mary Ludwig

(57) ABSTRACT

A fire-resistant utility pole sleeve comprising two fire-resistant layers with a semicircular cross section for sleeving an outer side of a pole. Two ends of each of the fire-resistant layers comprise connectors and the fire-resistant layers are operable to be connected to each other through the connectors. Inner layers and outer layers of the fire-resistant layers are support protection layers. A ceramic fiber material may fill a gap between the support protection layers. The fire-resistant utility pole sleeve in a preferred embodiment may effectively protect a wooden pole, a steel pole and a composite pole by providing fire-resistant performance of the poles and may be mounted on previously deployed poles in areas prone to wildfires to protect the poles from fire damage.

6 Claims, 3 Drawing Sheets

FIRE-RESISTANT UTILITY POLE SLEEVE

CROSS-REFERENCE TO RELATED APPLICATIONS

This application is a continuation-in-part of Chinese utility mode application number 2020020374708.4, filed on Mar. 23, 2020, entitled "FIREPROOF UTILITY POLE SLEEVE", the entire content of which is incorporated herein by reference.

BACKGROUND OF THE INVENTION

Field of the Art

The present disclosure relates to the field of electrical power, and in particular, to a fire-resistant sleeve for use with a power transmission or power distribution utility pole.

Discussion of the State of the Art

In a power utility network, a pole is a very common type of facility used to carry power grid wires. However, typical poles are generally made of wood, concrete, steel pipes or a glass fiber reinforced plastic (FRP) composite material. Wooden, steel and FRP composite poles often have poor fire resistance performance and are easily burned in the case of wildfire in forest areas, curtailing power transmission, causing property damage, and financial losses.

Accordingly, what is needed in the art is a mountable fire-resistant utility pole sleeve to protect utility poles in areas where fires may occur.

SUMMARY OF THE INVENTION

According to a preferred embodiment of the invention, a fire-resistant utility pole sleeve is disclosed. The fire-resistant utility pole sleeve comprises two fire-resistant layers with a semicircular cross section for sleeving an outer side of a pole, two ends of each of the fire-resistant layers are provided with connectors, and the fire-resistant layers are connected to each other through the connectors. Inner layers and outer layers of the fire-resistant layers may be support protection layers, and a ceramic fiber material may fill a gap between the support protection layers.

According to the embodiment, the fire-resistant utility pole sleeve advantageously performs fire-resistant protection on a wooden pole, a steel pole, a glass fiber reinforced plastic composite pole, or the like, and can be mounted on poles in, for example, an area prone to wildfires (for example, a forest) to protect the poles from damage in the event of a wildfire.

In some embodiments, flame-retardant glass fiber cloth or high silica fiberglass cloth may be added between the ceramic fiber material and each of the support protection layers. The flame-retardant glass fiber cloth can more effectively improve the fire-resistance and flame-retardant effect of the fire-resistant layer. The high silica fiberglass cloth may comprise a silica content of 40-96%, with a preferred minimum silica content of 65%. In other embodiments, a glass fiber cloth may be made of high-purity glass comprising quartz fibers.

In some embodiments, a fire-resistant coating may be applied between the ceramic fiber material and each of the support protection layers. Accordingly, the fire-resistant layer, and the fire-resistant coating may effectively improve the fire-resistant and flame-retardant performance of the fire-resistant utility pole sleeve.

In some embodiments whereby a pole is made of a wood material, steel or a glass fiber reinforced plastic composite material, the fire-resistant utility pole sleeve is advantageous in pole survivability when deployed in areas prone to wildfires.

In some embodiments, the support protection layers may be made of a metal material with a high melting point, UV resistance and high strength. Accordingly, a preferable material for the support protection layer is operable to support the fire-resistant sleeve and play a role of resisting an external force. In some embodiments, a material with a higher melting point may be used.

In some embodiments, the connector is made of a metal material with high temperature resistance and high strength. Accordingly, a preferable material of the connector promotes a reliable connection between the two fire-resistant layers. In some embodiments, the support protection layers may be made of a glass fiber mat material with a high melting point, UV resistance and high strength. In some embodiments the glass fiber mat may be coated with a waterproof coating. Accordingly, a preferable material for the support protection layer is operable to support the fire-resistant sleeve and play a role of resisting an external force. One with ordinary skill in the art will readily understand that some materials described herein may not have a true melting point but rather a softening point. Melting points of materials described herein may be in the range of 700° C.-2000° C.; however, materials with a different melting (or softening) point may be used.

BRIEF DESCRIPTION OF THE DRAWING FIGURES

Figures 5A, 5B, 5C:
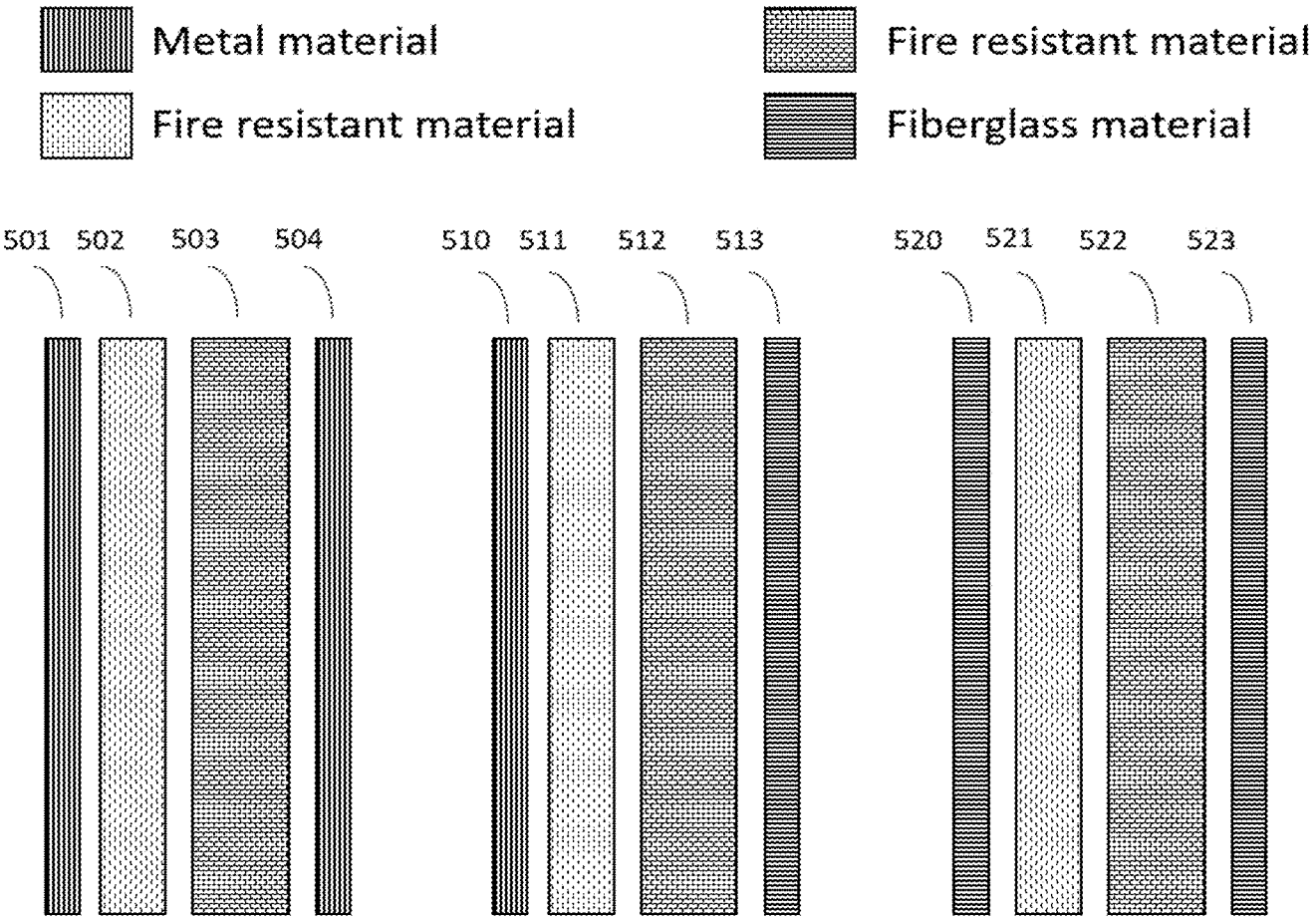

FIGS. 5A-C are block diagrams illustrating exemplary embodiments of a fire-resistant sleeve, according to various embodiments of the invention.

In the drawings: 1—pole, 2—fire—resistant layer, 3—connector, 4—support protection layer, 5—ceramic fiber material, 6—flame—retardant glass fiber cloth, 7—fire—resistant coating.

DETAILED DESCRIPTION

One or more different inventions may be described in the present application. Further, for one or more of the inventions described herein, numerous alternative embodiments may be described; it should be appreciated that these are presented for illustrative purposes only and are not limiting of the inventions contained herein or the claims presented herein in any way.

Figure 1:
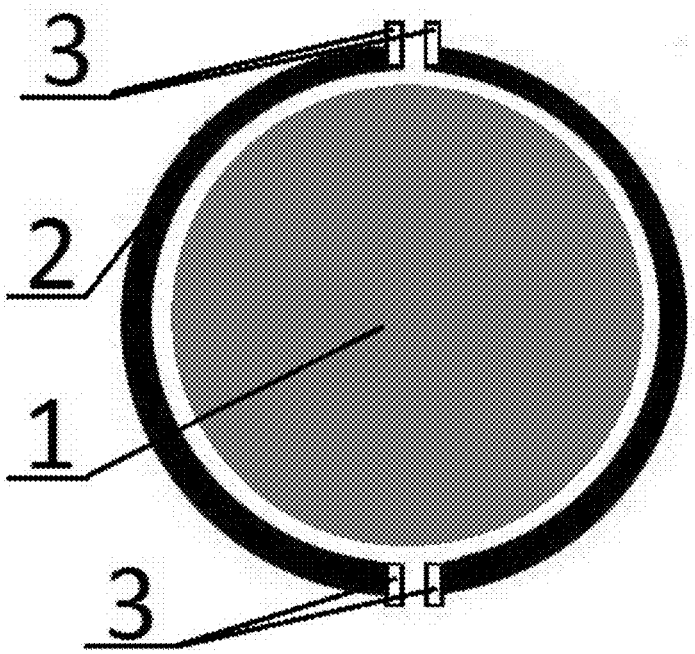
FIG. 1 is a cross-sectional structural view of a fire-resistant utility pole sleeve according to a preferred embodiment of the invention.

FIG. 1 schematically shows the structure of a fire-resistant utility pole sleeve according to an embodiment of the invention.

Figure 2:
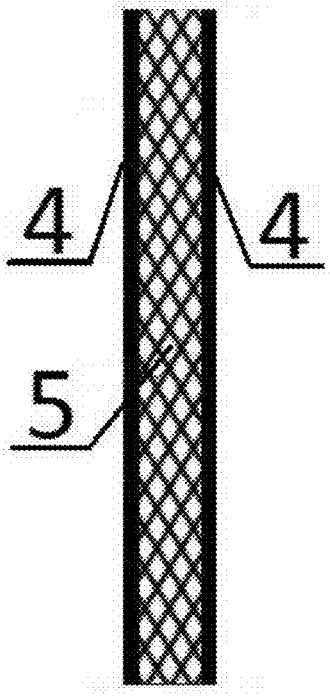
FIG. 2 is a schematic view of a layered structure of an embodiment of the fire-resistant layer shown in FIG. 1.

FIG. 2 shows a layered structure of an embodiment of a fire-resistant layer in FIG. 1. As shown in FIG. 1 and FIG.

2, the fire-resistant sleeve is used to sleeve an outer side of a pole 1 to protect the pole 1, and is generally used for pole 1 made of a wood material, steel material, or a glass fiber reinforced plastic composite material, especially for the pole 1 mounted in a forest and another area prone to fire.

The fire-resistant sleeve is formed by two separate fire-resistant layers 2 in an encircling manner. The structures of the two fire-resistant layers 2 may be the same, and the cross sections of the fire-resistant layers 2 may be semicircular. Two ends of each fire-resistant layer 2 are provided with connectors 3. The fire-resistant layers 2 may be connected to each other through the connectors 3 at two ends to jointly form a cylinder, and the pole 1 may be sleeved in the cylinder for protection.

The fire-resistant layer 2 may be formed by stacking a plurality of layers of different materials. Inner layers and outer layers of the fire-resistant layers 2 may be support protection layers 4. The support protection layers 4 may be made of a metal material with high temperature resistance and high strength, fiberglass material, or another material. A ceramic fiber material 5 may fill a gap between the support protection layers 4. The ceramic fiber material 5 has advantages of light weight, high temperature resistance, low thermal conductivity (and the like), is a good flame-retardant and heat-insulating material, and can effectively improve a fire-resistant effect of the fire-resistant layers 2.

Preferably, connector 3 may be generally made of a metal with high temperature resistance and high strength and may have a certain fire-resistant effect.

Figure 3:
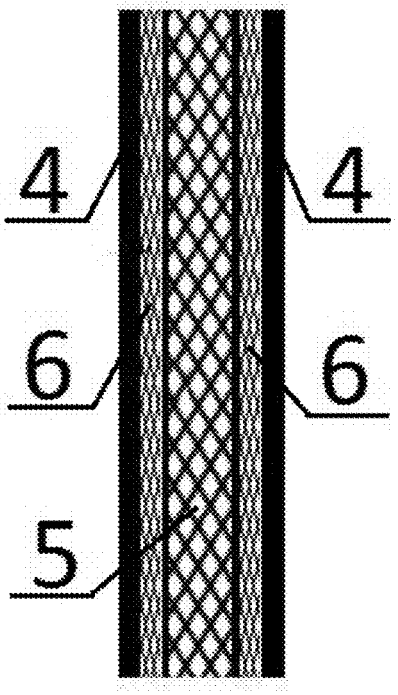
FIG. 3 is a schematic view of a layered structure of a second embodiment of the fire-resistant layer shown in FIG. 1.

FIG. 3 shows a layered structure of a second embodiment of the fire-resistant layer 2 in FIG. 1. As shown in FIG. 3, on the basis of the first embodiment, flame-retardant glass fiber cloth 6 may further fill a gap between the ceramic fiber material 5 and each support protection layer 4. The flame-retardant glass fiber cloth 6 may provide additional heat resistance, insulative and tensile strength, which can not only effectively improve the fire-resistant effect of the fire-resistant layer 2, but also provide leakage prevention, corrosion resistance and impact resistance, thereby further improving the protective effect on pole 1.

Figure 4:
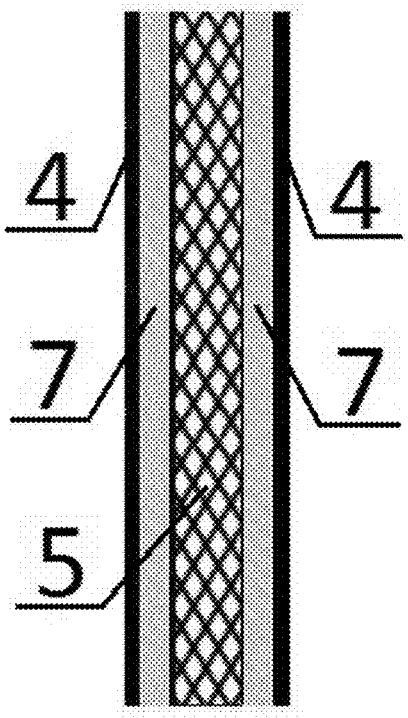
FIG. 4 is a schematic view of a layered structure of a third embodiment of the fire-resistant layer shown in FIG. 1.

FIG. 4 shows a layered structure of another embodiment of the fire-resistant layer 2 in FIG. 1. As shown in FIG. 4, on the basis of the first embodiment, a fire-resistant coating 7 may be further applied between the ceramic fiber material 5 and each support protection layer 4, thereby further improving the fire-resistant effect of the fire-resistant layer 2.

FIGS. 5A-C are block diagrams illustrating exemplary embodiments of a fire-resistant sleeve, according to various embodiments of the invention. According to the embodiments, layers may include metal material, fire-resistant material, and fiberglass material. It should be noted that the spaces between the layers are for illustrative purposes only and layers may be together with or without a gap.

FIG. 5A illustrates a first embodiment comprising: a first layer 501 which may be a metal material, for example, stainless steel, a second layer 502 which may be a first fire-resistant material, a third layer 503 which may be a second fire-resistant material, a fourth layer 504 which may be a metal material, for example, stainless steel.

FIG. 5B illustrates a first embodiment comprising: a first layer 510 which may be a metal material, for example, stainless steel, a second layer 511 which may be a first fire-resistant material, a third layer 512 which may be a second fire-resistant material, a fourth layer 513 which may be a fiberglass material.

FIG. 5C illustrates a first embodiment comprising: a first layer 520 which may be a fiberglass material, a second layer 521 which may be a first fire-resistant material, a third layer 522 which may be a second fire-resistant material, a fourth layer 523 which may be a fiberglass material.

It should be appreciated by one with ordinary skill in the art that other embodiments may include additional layers and may use different materials. The above embodiments are exemplary embodiments of various embodiments of the present invention and do not limit the invention in any form. Any simple variation, equivalent change and modification made to the above embodiments according to the technical essence of the various embodiment still falls within the protection scope of the technical solution of the various embodiments.

What is claimed is:

1. An apparatus for protecting a utility pole from wildfires, the utility pole having an outer side, the apparatus comprising:

two outer layers for sleeving the outer side of the utility pole, each of the two outer layers having a layered structure comprising:

an inner support protection layer and an outer support protection layer, each comprised of a metal material, arranged in stacked relation with a gap therebetween;

a ceramic fiber material disposed within the gap; and at least one adjacent layer comprised of glass fiber cloth, the at least one adjacent layer disposed between the ceramic fiber material and one of the inner support protection layer and the outer support protection layer; and wherein two ends of each of the two outer layers comprise connectors, the connectors operable to be connected to each other such that the inner support protection layers are oriented toward and substantially surround the outer side of the utility pole and the outer support protection layers are oriented away from the outer side of the utility pole.

2. The apparatus according to claim 1, wherein a fire-resistant coating is applied between the ceramic fiber material and one of the inner support protection layer and the outer support protection layer.

3. The apparatus according to claim 1, wherein the connectors are made of a metal material.

4. The apparatus according to claim 1, wherein the two outer layers comprise a semicircular cross section.

5. The apparatus according to claim 1, wherein the glass fiber cloth of the at least one adjacent layer is a high silica a fiberglass material.

6. The apparatus according to claim 5, wherein the high silica fiberglass material comprises, at least, 65% silica content.

* * * * *